US007760047B2

(12) United States Patent
El Rai et al.

(10) Patent No.: US 7,760,047 B2
(45) Date of Patent: Jul. 20, 2010

(54) COUPLING ELEMENT FOR ELECTROMAGNETIC COUPLING OF AT LEAST TWO CONDUCTORS OF A TRANSMISSION LINE

(75) Inventors: Samir El Rai, Duisburg (DE); Ralf Tempel, Duisburg (DE)

(73) Assignee: ATMEL Duisburg GmbH, Duisburg (DE)

( * ) Notice: Subject to any disclaimer, the term of this patent is extended or adjusted under 35 U.S.C. 154(b) by 19 days.

(21) Appl. No.: 11/599,399

(22) Filed: Nov. 15, 2006

(65) Prior Publication Data

US 2007/0109072 A1 May 17, 2007

(30) Foreign Application Priority Data

Nov. 15, 2005 (DE) ..... 10 2005 054 348

(51) Int. Cl.
*H01P 5/12* (2006.01)
*H01P 3/08* (2006.01)

(52) U.S. Cl. ..... 333/116; 222/205

(58) Field of Classification Search ..... 333/117, 333/118, 109, 202, 204, 205, 116
See application file for complete search history.

(56) References Cited

U.S. PATENT DOCUMENTS 2,935,705 A 5/1960 Reis
4,121,182 A 10/1978 Makimoto et al.
4,763,089 A 8/1988 Pon
6,600,386 B1 7/2003 Löbl et al.

FOREIGN PATENT DOCUMENTS

DE 199 15 246 A1 10/2000
EP 1039574 9/2000

OTHER PUBLICATIONS

Toyoda, "Variable Coupling Directional Couplers Using Varactor Diodes", Institute of Electrical and Electronics Engineers, International Microwave Symposium, pp. 419-421, 1982.

*Primary Examiner*—Dean O Takaoka
(74) *Attorney, Agent, or Firm*—Muncy, Geissler, Olds & Lowe, PLLC

(57) ABSTRACT

A coupling element is disclosed for electromagnetic coupling of at least two conductors of a transmission line, wherein the coupling element is arranged between a first conductor and a second conductor of the transmission line and has at least one discrete component. The coupling element can have at least one first branch embodied as a transmission line segment that is associated with the first conductor, and a second branch embodied as a transmission line segment that is associated with the second conductor. The at least one discrete component can thereby be provided for connecting the first branch to the second branch.

12 Claims, 1 Drawing Sheet

COUPLING ELEMENT FOR ELECTROMAGNETIC COUPLING OF AT LEAST TWO CONDUCTORS OF A TRANSMISSION LINE

This nonprovisional application claims priority under 35 U.S.C. §119(a) on German Patent Application No. DE 102005054348, which was filed in Germany on Nov. 15, 2005, and which is herein incorporated by reference.

BACKGROUND OF THE INVENTION

1. Field of the Invention

The present invention relates to a coupling element for the electromagnetic coupling of at least two conductors of a transmission line, wherein the coupling element is arranged between a first conductor and a second conductor of the transmission line and has at least one discrete component.

2. Description of the Background Art

Conventional coupling elements of this type are equipped with a varactor diode, for example, which connects different conductors of the transmission line to one another and thus implements a controllable capacitive coupling of the two conductors. In this arrangement, the degree of coupling of this capacitive coupling can be set by means of a control signal provided to the varactor diode.

The disadvantage of these conventional coupling elements is the relatively small tuning range that results from the coupling of the conductors of the transmission line to the varactor diode. Furthermore, in such devices it is always only possible to simultaneously change the impedance and the propagation constant of the transmission line.

SUMMARY OF THE INVENTION

It is therefore an object of the present invention to provide a coupling element of such that a larger tuning range with regard to the electromagnetic coupling of the conductors of a transmission line is possible together with more flexible tuning.

This object is attained in a coupling element that includes at least one first branch embodied as a transmission line segment that is associated with the first conductor, a second branch embodied as a transmission line segment that is associated with the second conductor, and at least one discrete component is provided for connecting the first branch to the second branch.

The use of branches embodied as a transmission line segment makes it possible to provide a capacitive coupling as well as an inductive coupling between the conductors of the transmission line, wherein the respective degree of coupling is variable over wide ranges through appropriate geometric design of the transmission line segments. Taken as a whole, the use of transmission line segments in the coupling element thus makes possible a greater tuning range than in conventional devices with regard to the electromagnetic coupling of the conductors of the transmission line.

In an embodiment of the present invention, the discrete component can be designed as a resistive or capacitive component. A discrete component designed as a capacitive component has a controllable capacitance so that the capacitive coupling between the branches of the coupling element can be determined by adjusting the capacitance of the capacitive component. In this process, a change in the inductive coupling between the branches of the coupling element also takes place very advantageously at the same time. In like manner, the possibility exists in the case of a controllable resistive component of influencing a flow of current between the branches of the coupling element, by which the inductive coupling between the conductors of the transmission line is likewise changed.

In another embodiment of the present invention, the discrete component is designed as a varactor diode or as a transistor, in particular as a field effect transistor. In general, it is possible to use any electronic component that has a controllable capacitance or even a controllable ohmic resistance for coupling the branches of the coupling element. A configurable capacitor matrix (CDAC) may also be used for coupling the branches. The use of a noncontrollable capacitive or inductive component is likewise possible.

In another embodiment, each branch of the coupling element can have at least one first segment extending parallel to either the first conductor or the second conductor of the transmission line. This first segment serves, in particular, to produce an inductive coupling of the coupling element or the relevant branch of the coupling element to the particular conductor of the transmission line with which the relevant branch of the coupling element is associated. The desired degree of coupling can be influenced in a conventional manner, through the selection of the spacing between the conductor and the first segment of the branch of the coupling element, through the length of the first segment, or through additional factors determining the geometry of the coupling element.

Another embodiment provides that each branch of the coupling element can have at least one second segment, extending perpendicular to the first segment. Such second segments extending perpendicular to the first segments have, for their part, an effect on the inductive coupling of the conductors of the transmission line, but also serve primarily to influence the capacitive coupling between the conductors of the transmission line.

On the one hand, the second segments extending perpendicular to the first segments contribute directly to the capacitive coupling of the branches of the coupling elements, and thus to the capacitive coupling between the conductors of the transmission line as well; on the other hand, the second segments of the coupling element serve to contact the discrete component or components that connect the two branches of the coupling element to one another.

A transmission line can have one or more coupling elements and is thus tunable over a wide range with regard to its propagation constant or its impedance.

In another embodiment of the transmission line, the transmission line and the coupling element or elements are monolithically integrated in an integrated circuit.

Moreover, according to another embodiment of the present invention, it is also possible for the transmission line to be designed as a differential transmission line.

In another embodiment, the transmission line can be located in a first metallization level of the integrated circuit, and at least one coupling element can be located in another metallization level of the integrated circuit. In this way, it is possible, for example, to arrange the branches of the coupling element directly above or below a conductor of the transmission line implemented in a different metallization level, by which means the spacing to be provided between the conductors of the transmission line can be reduced, for example, and by which means an additional capacitive coupling arises at the same time between the branch of the coupling element and the conductors of the transmission line.

As an alternative to the aforementioned embodiment, it is also possible to arrange both the transmission line itself and the coupling element or coupling elements in the same metallization level of an integrated circuit, so that the first segments of the branches of the coupling elements and the respective conductors of the transmission line have a lateral spacing from one another.

On the whole, the coupling element can be used with conventional transmission lines, such as microstrip lines or the like, which are located on a substrate provided for this purpose, as well as with transmission lines which are monolithically integrated into integrated circuits.

In contrast to conventional coupling elements, a suitable design of the coupling element also makes it possible to achieve tunability in the same direction for an inductive coupling component and a capacitive coupling component; although this changes a propagation constant of the transmission line that is provided with the coupling element or coupling elements, it does not change the impedance of this transmission line. When a transmission line is equipped with a sufficient number of coupling elements, the entire segment of this transmission line can be altered in terms of its propagation constant in the manner described above.

In another embodiment of the coupling element, at least one of the branches of the coupling element can have multiple first segments, extending, for example, parallel to a conductor of the transmission line, which can be selectably connected to one another, for example by controllable capacitive or resistive components. In this way, the degree of an inductive coupling between the relevant conductor of the transmission line and the coupling element can be influenced. By changing only this inductive coupling—analogous to changing a capacitive coupling—the propagation constant or the impedance of the transmission line can be changed.

Moreover, by tuning an inductive coupling component and a capacitive coupling component in opposite directions, the coupling element makes it possible to alter the impedance of the transmission line provided with the coupling element or elements, but not the propagation constant of this transmission line. When a transmission line is equipped with a sufficient number of coupling elements, the entire segment of this transmission line can be altered in terms of its impedance in the manner described above.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1A:
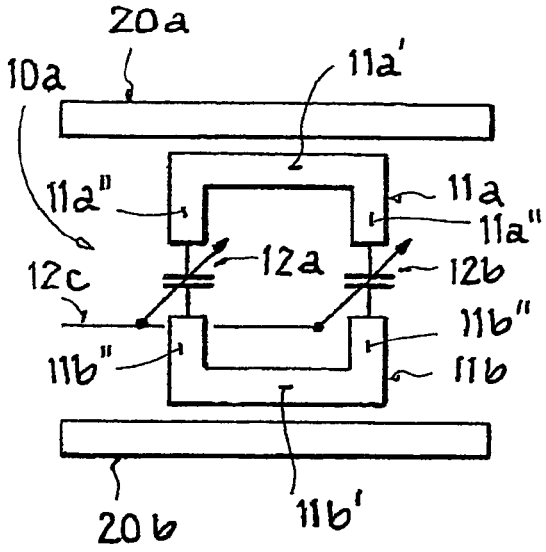
FIG. 1*a* illustrates a first embodiment of the coupling element.

FIG. 1*a* shows a first embodiment of the coupling element 10*a*, which is arranged between two conductor 20*a*, 20*b* of a transmission line in order to electromagnetically couple them to one another, thereby changing the characteristics of the transmission line. In each case, only the segments of the two conductors 20*a*, 20*b* of the transmission line that are located directly in the vicinity of the coupling element are shown in FIG. 1*a* and in the other figures.

As is evident from FIG. 1*a*, the coupling element 10*a* has a first branch 11*a*, which is associated with the conductor 20*a* of the transmission line. In addition, the coupling element 10*a* has a second branch 11*b*, which is associated with the second conductor 20*b* of the transmission line. According to the invention, both of the branches 11*a*, 11*b* are designed as transmission line segments, and thus permit improved inductive and capacitive coupling between the conductors 20*a*, 20*b* of the transmission line as compared to conventional coupling elements.

Each branch 11*a*, 11*b* of the coupling element 10*a* has a first segment 11*a*' or 11*b*', which is arranged parallel to the first conductor 20*a* or the second conductor 20*b* of the transmission line, thus accomplishing especially good inductive coupling between the coupling element 10*a* and the applicable conductors 20*a*, 20*b* of the transmission line.

In addition, each branch 11*a*, 11*b* in the embodiment of the coupling element depicted in FIG. 1*a* has two second segments 11*a*", 11*b*" each of which extends perpendicular to the first or second segment 11*a*', 11*b*', which on the one hand effect a capacitive coupling between the branches 11*a*, 11*b* of the coupling element 10*a*, and which on the other hand are each connected to a capacitive component 12*a*, 12*b* for the purpose of connecting the two branches 11*a*, 11*b*, or the applicable second segments 11*a*", 11*b*" of the two branches 11*a*, 11*b*, to one another.

In the embodiment described above are controllable capacitive elements, for example varactor diodes, whose capacitance can be controlled by applying a suitable DC voltage to the control line 12*c*.

Very advantageously, in the embodiment shown in FIG. 1*a*, both the inductive and the capacitive coupling between the conductors 20*a*, 20*b* of the transmission line can be achieved solely by changing the capacitance of the controllable capacitors 12*a*, 12*b*. For example, by reducing the capacitance of the elements 12*a*, 12*b* the inductive coupling between the branches 11*a*, 11*b*, and thus also between the conductors 20*a*, 20*b* of the transmission line, can also be directly influenced, since changing the capacitance correspondingly changes the impedance of the elements 12*a*, 12*b*.

At the same time, when the capacitances of the elements 12*a*, 12*b* change, the capacitive coupling between the branches 11*a*, 11*b* also changes. Thus, in the embodiment shown in FIG. 1*a*, the capacitive coupling also decreases through reduction of the capacitance of the elements 12*a*, 12*b*, so that the overall result is a reduction of the capacitive coupling and the inductive coupling between the lines 20*a*, 20*b* of the transmission line.

The impedance of a transmission line assumed to be lossless is proportional to the root of the quotient of an inductance per unit length L' of the transmission line and a capacitance per unit length C' of the transmission line, which is to say $$Z \propto \sqrt{\frac{L'}{C'}}.$$

Similarly, the propagation constant γ of a transmission line assumed to be lossless is:

$$\gamma \propto \sqrt{L'C'}.$$

Accordingly, a reduction in the same direction of the capacitive and inductive coupling of the lines 20*a*, 20*b* of the transmission line such as described above, which corresponds to an appropriate change in an inductance per unit length L' or a capacitance per unit length C' of the transmission line segment equipped with the coupling element 10*a*, causes no change in the impedance of the transmission line segment in question. However, the propagation coefficient γ of the relevant transmission line segment does change according to the formula given above. In the present example, this means that the value of the propagation constant γ decreases, while the impedance Z remains constant.

Similarly, it is also possible to achieve an increase in the inductive and capacitive coupling between the conductors 20*a*, 20*b* of the transmission line, and thus an increase in the value of the propagation constant γ, by increasing the capacitances of the elements 12*a*, 12*b*, while the impedance Z of the transmission line segment equipped with the coupling element 10*a* remains constant.

Figure 1B:
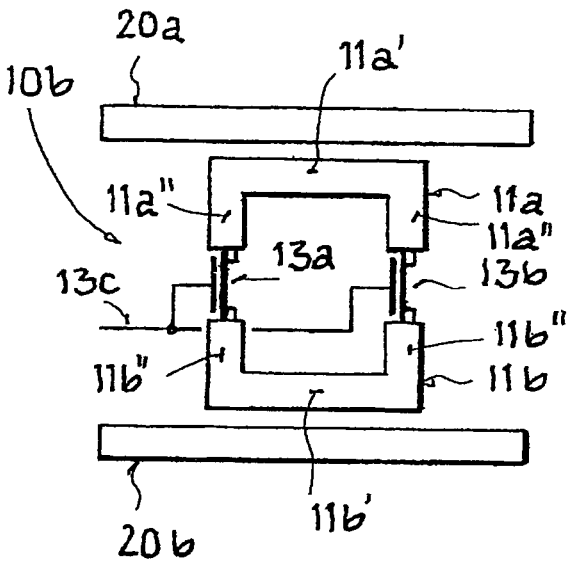
FIG. 1*b* illustrates a second embodiment of the coupling element.

FIG. 1*b* shows another embodiment of the coupling element 10*b*, whose branches 11*a*, 11*b* have the same structure as the branches of the coupling element 10*a* illustrated in FIG. 1*a*. In contrast to the embodiment shown in FIG. 1*a*, however, the branches 11*a*, 11*b* of the coupling element 10*b* from FIG. 1*b* are provided between them with controllable resistive elements designed as field effect transistors 13*a*, 13*b* whose ohmic resistance can be set through a control signal 13*c*. Hence, an appropriate choice of the ohmic resistance of the resistive elements 13*a*, 13*b* can directly influence an inductive coupling between the branches 11*a*, 11*b* of the coupling element 10*b*, and thus also influence the inductive coupling between the conductors 20*a*, 20*b* of the transmission line.

Figure 2A:
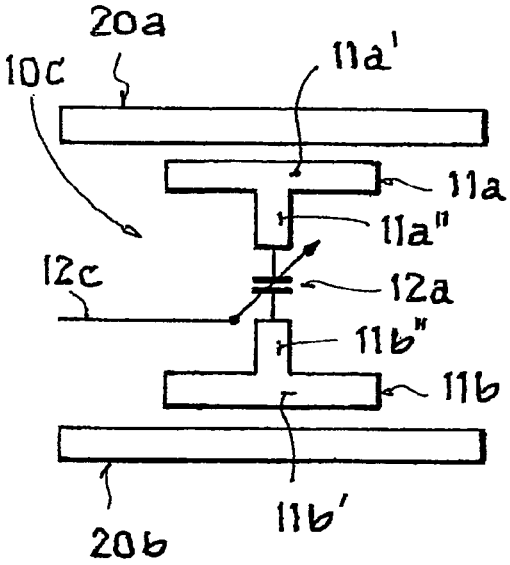
FIG. 2*a* illustrates a third embodiment of the coupling element.

Another embodiment of the invention is illustrated in FIG. 2*a*. In this variant of the invention, the coupling element 10*c* has, like the two embodiments described above, a first segment 11*a*', 11*b*', which extends essentially parallel to the respective conductor 20*a*, 20*b* of the transmission line, and thus implements an inductive coupling, in particular, between the branches 11*a*, 11*b*.

A capacitive coupling between the conductors 20*a*, 20*b* and the first segments 11*a*', 11*b*' is also provided.

Unlike the embodiments of the present invention shown in FIGS. 1*a* and 1*b*, the variant of the coupling element 10*c* shown in FIG. 2*a* has only one second segment 11*a*", 11*b*" for each branch 11*a*, 11*b*, the second segment preferably extending approximately perpendicular to the applicable first segment 11*a*', 11*b*'.

Also in the variant of the invention illustrated in FIG. 2*a*, a connection of the second segments 11*a*", 11*b*" is implemented by a capacitive element 12*a* with a controllable capacitance, which can be changed by the application of a suitable control voltage to the connection 12*c*.

Figure 2B:
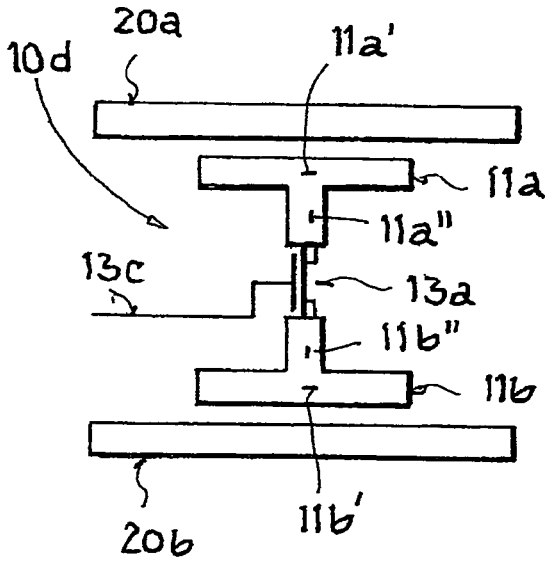
FIG. 2*b* illustrates a fourth embodiment of the coupling element.

Another variant of the invention is illustrated in FIG. 2*b*. This variant of the invention differs from the embodiment illustrated in FIG. 2*a* in that the coupling element 10*d* has a resistive element with controllable ohmic resistance in the form of a field effect transistor 13*a*. In similar fashion to the coupling element 10*b* from FIG. 1*b*, in the coupling element 10*d* shown in FIG. 2*b* an inductive coupling of the two branches 11*a*, 11*b* can be set by the application of a suitable control signal to the connection 13*c*.

On the whole the present invention, in contrast to conventional coupling elements, very advantageously provides the capability to simultaneously change the capacitive and the inductive coupling between the conductors 20*a*, 20*b* of the transmission line such that, for example, only the propagation constant γ changes, but not the impedance Z of the transmission line. The coupling element can be used to particular advantage both with conventional transmission lines such as microstrip lines and the like, as well as with transmission lines that are monolithically integrated into integrated circuits.

In the case of a monolithically integrated transmission line with one or more coupling elements, the option is fundamentally provided of implementing both the transmission line and the coupling element or elements in the same metallization level of the integrated circuit, by which means an especially simple construction is achieved and any additional metallization levels that may be present are available for other applications. Alternatively, however, it is also possible to arrange a monolithically integrated transmission line and corresponding coupling elements in different metallization levels of an integrated circuit so that the segments of the transmission line 20*a*, 20*b* overlap at least partly with transmission line segments of the branches 11*a*, 11*b* of coupling elements, thus introducing an additional capacitive coupling component.

The coupling element can be used in differential transmission lines as well as in asymmetric transmission lines.

A plurality of coupling elements can be arranged within a transmission line whose parameters, such as the propagation constant γ, can thus be changed simply by driving the appropriate elements 12*a*, 12*b*, 13*a*, 13*b* and their control lines 12*c*, 13*c*. Such a transmission line can be used to construct voltage controlled oscillators (VCO), filters, and other components which utilize transit-time effects in the signal propagation of electromagnetic waves on a transmission line. For example, the transmission line is especially well suited for constructing reflection oscillators, whose characteristics during oscillator operation can be tuned by means of an appropriate change in the characteristics of the transmission line.

The use of branches 11*a*, 11*b* embodied as transmission line segments makes it possible to provide a capacitive coupling as well as an inductive coupling between the conductors 20*a*, 20*b* of the transmission line, wherein the respective degree of coupling is variable over wide ranges through appropriate geometric design of the transmission line segments, among other means. Taken as a whole, the use of transmission line segments in the coupling element thus makes possible a greater tuning range in comparison to conventional devices with regard to the electromagnetic coupling of the conductors 20*a*, 20*b* of the transmission line.

In another embodiment, the coupling element, at least one of the branches 11*a*, 11*b* of the coupling element has multiple first segments 11*a*', preferably extending parallel to a conductor 20*a*, 20*b* of the transmission line, which may be connected to one another if desired, for example by controllable capacitive or resistive components. In this way, primarily the degree of an inductive coupling between the applicable conductor of the transmission line and the coupling element may be influenced. By solely changing this inductive coupling, it is possible to change the propagation constant γ or the impedance Z of the transmission line, similar to the change of a capacitive coupling.

Moreover, by tuning an inductive coupling component and a capacitive coupling component in opposite directions, the coupling element makes it possible to alter the impedance Z of the transmission line provided with the coupling element or elements, but not the propagation constant γ of this transmission line. When a transmission line is equipped with a sufficient number of coupling elements, the entire segment of this transmission line can be altered in terms of its impedance in the manner described above.

On the whole, therefore, the coupling element makes possible the simultaneous influencing of the impedance Z and the propagation constant γ of a transmission line, as well as the isolated influencing of either the impedance Z or the propagation constant γ, which corresponds to the electrical length of the transmission line.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A differential transmission line comprising:

a first conductor;

a second conductor; and at least one coupling element arranged between the first conductor and the second conductor, the coupling element configured for electromagnetic coupling of the first conductor and the second conductor of the differential transmission line, the coupling element comprising:

at least one first branch forming a first transmission line segment that is associated with the first conductor of the differential transmission line;

a second branch forming a second transmission line segment that is associated with the second conductor of the differential transmission line; and at least one discrete component configured to connect the first branch to the second branch.

2. The differential transmission line according to claim 1, wherein the discrete component is a resistive or capacitive component.

3. The differential transmission line according to claim 1, wherein the discrete component is a varactor diode, a transistor, or a field effect transistor.

4. The differential transmission line according to claim 1, wherein the first branch and the second branch have at least one first segment extending substantially parallel to the first conductor or to the second conductor of the transmission line.

5. The differential transmission line according to claim 1, wherein the first branch and the second branch have at least one second segment extending substantially perpendicular to the first segment.

6. The differential transmission line according to claim 5, wherein the second segment of the first branch is connected to the second segment of the second branch by the discrete component.

7. The differential transmission line according to claim 1, wherein the discrete component is directly connected with the first branch and the second branch.

8. The differential transmission line according to claim 1, wherein the coupling element is configured to change a propagation constant or an impedance of the differential transmission line.

9. The differential transmission line according to claim 1, wherein the differential transmission line is tunable via the coupling element.

10. A transmission line comprising:

at least one coupling element being arranged between a first conductor and a second conductor of the transmission line, the coupling element comprising:

at least one first branch forming a first transmission line segment that is associated with the first conductor;

a second branch forming a second transmission line segment that is associated with the second conductor; and at least one discrete component for connecting the first branch to the second branch, wherein the transmission line is a differential transmission line.

11. The transmission line according to claim 10, wherein the transmission line and the coupling element are monolithically integrated in an integrated circuit.

12. The transmission line according to claim 11, wherein the transmission line is located in a first metallization level of the integrated circuit, and wherein at least one coupling element is located in another metallization level of the integrated circuit.

* * * * *